US009714540B2

(12) United States Patent
Lorenzani et al.

(10) Patent No.: US 9,714,540 B2
(45) Date of Patent: Jul. 25, 2017

(54) FAST ROLL-UP DOOR COMPRISING A CURTAIN SPEED DETECTION DEVICE

(71) Applicant: ASSA ABLOY Entrance Systems AB, Landskrona (SE)

(72) Inventors: Mauro Lorenzani, Malnate (IT); Armando Vecchi, Monza (IT)

(73) Assignee: ASSA ABLOY ENTRANCE SYSTEMS AB, Landskrona (SE)

( * ) Notice: Subject to any disclaimer, the term of this patent is extended or adjusted under 35 U.S.C. 154(b) by 0 days.

(21) Appl. No.: 15/117,405

(22) PCT Filed: Feb. 10, 2015

(86) PCT No.: PCT/EP2015/052764
§ 371 (c)(1),
(2) Date: Aug. 8, 2016

(87) PCT Pub. No.: WO2015/121256
PCT Pub. Date: Aug. 20, 2015

(65) Prior Publication Data

US 2016/0348430 A1 Dec. 1, 2016

(30) Foreign Application Priority Data

Feb. 12, 2014 (SE) ..... 1450154

(51) Int. Cl.
*E06B 9/88* (2006.01)
*E06B 9/13* (2006.01)
(Continued)

(52) U.S. Cl.
CPC ..... *E06B 9/88* (2013.01); *E06B 9/13* (2013.01); *E06B 9/581* (2013.01); *E06B 9/68* (2013.01);
(Continued)

(58) Field of Classification Search
CPC ..... E06B 9/88; E06B 9/68; E06B 9/13; E06B 9/92; E06B 9/581; E06B 9/58;
(Continued)

(56) References Cited

U.S. PATENT DOCUMENTS 4,529,920 A 7/1985 Yoshida et al.
4,825,921 A * 5/1989 Rigter ..... E06B 9/54 160/23.1
(Continued)

FOREIGN PATENT DOCUMENTS

DE 90 13 491 U1 11/1990
DE 299 01664 U1 4/1999
(Continued)

OTHER PUBLICATIONS

International Search Report and Written Opinion mailed Jun. 12, 2015 in corresponding International Application No. PCT/EP2015/052764.
(Continued)

*Primary Examiner* — Blair M Johnson
(74) *Attorney, Agent, or Firm* — Wissing Miller LLP

(57) ABSTRACT

The present invention concerns a fast roll-up door for closing an aperture (20), said roll- up door comprising:

(a) a curtain (1) having two opposite and parallel lateral edges extending along a longitudinal direction, and two opposite end edges joining the lateral edges, the curtain comprising a continuous bead (3*b*) extending parallel and adjacent to each of the two lateral edges, said continuous beads (3*b*) being held in, (b) a pair of elongated guiding rails (4) suitable for interacting with the continuous beads (3*b*) of the lateral edges of the curtain, for holding said lateral edges, and for guiding them as the curtain is being wound or unwound about a rotating axle, X1, characterized in that, the curtain comprises a plurality of windows (8) of same geometry and evenly distributed along
(Continued)

a line the continuous beads (3*b*) of the lateral edges of the curtain and in that, the roll-up door further comprises a speed device (10) for detecting and monitoring during the winding and unwinding of the curtain about the rotating axle, X1, of the time sequence of passage of the windows (8) before a fixed point, and thus for determining the instantaneous translation speed of the curtain along the guiding rails (4).

16 Claims, 4 Drawing Sheets

(51) Int. Cl.
*E06B 9/58* (2006.01)
*E06B 9/92* (2006.01)
*E06B 9/68* (2006.01)

(52) U.S. Cl.
CPC ..... *E06B 9/92* (2013.01); *E06B 2009/6818* (2013.01); *E06B 2009/6827* (2013.01)

(58) Field of Classification Search
CPC ..... E06B 2009/6818; E06B 2009/6854; E06B 2009/6872
USPC ..... 160/273.1, 310
See application file for complete search history.

(56) References Cited

U.S. PATENT DOCUMENTS 5,540,269 A * 7/1996 Plumer ..... E06B 9/84 160/133
7,275,581 B2 * 10/2007 Coenraets ..... E06B 9/17 160/237
2007/0277942 A1 12/2007 Dondlinger et al.
2008/0141599 A1 * 6/2008 Akdag ..... E06B 9/08 52/202
2010/0236729 A1 * 9/2010 Fischer ..... E06B 9/88 160/318
2012/0053731 A1 * 3/2012 Feldstein ..... E06B 9/42 700/275
2015/0041076 A1 * 2/2015 Andre de la Porte .. E06B 9/581 160/266
2015/0136334 A1 * 5/2015 Iglesias Ballester . E05D 15/165 160/7
2016/0348424 A1 * 12/2016 Lorenzani ..... E06B 9/15
2016/0348430 A1 * 12/2016 Lorenzani ..... E06B 9/88

FOREIGN PATENT DOCUMENTS

EP 0 959 222 A2 11/1999
EP 1245781 A1 * 10/2002
EP 2 441 911 A1 4/2012
GB 2 177 792 A 1/1987
WO WO 2009/090097 A2 7/2009

OTHER PUBLICATIONS

International-Type Search Report mailed Aug. 29, 2014 in priority application No. 1450154-8 filed in Sweden.
Office Action issued in corresponding Chinese Application No. 201580007996.1 dated Jan. 3, 2017 and its English Translation.

* cited by examiner

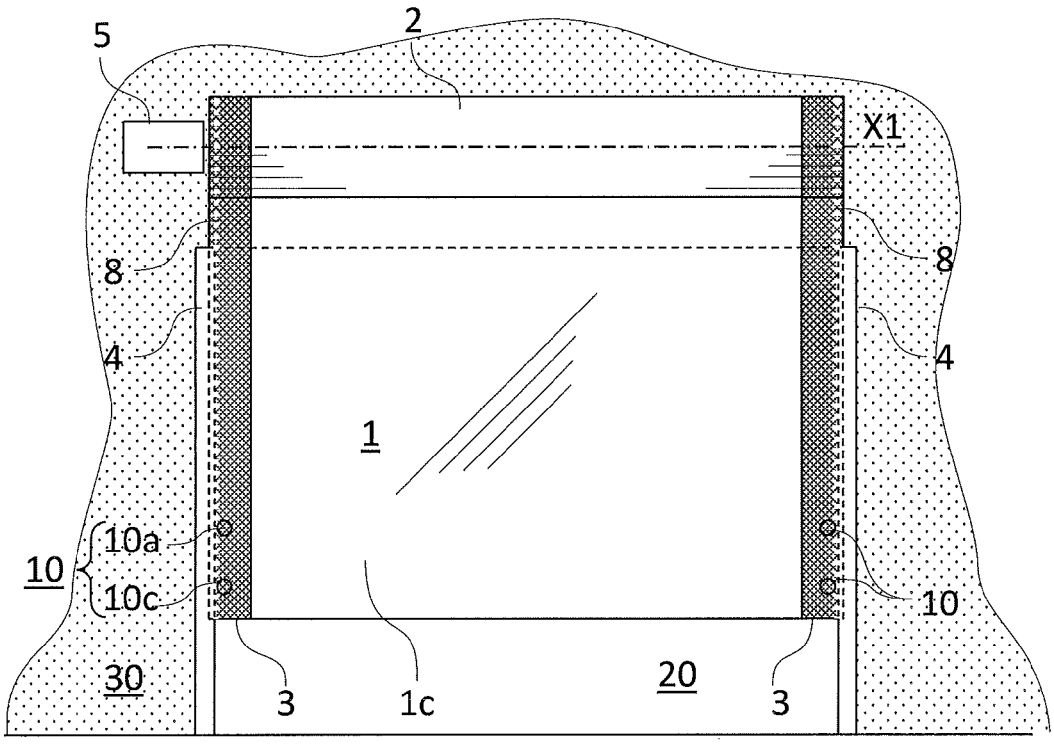
(a)
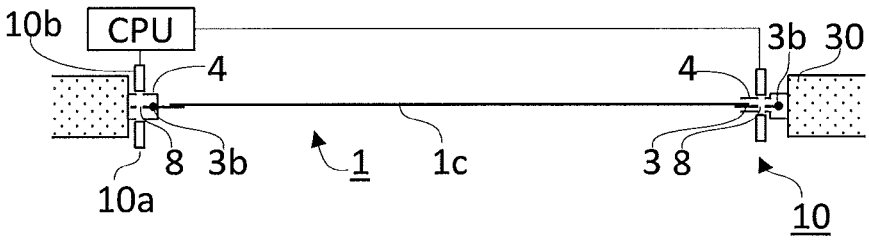
(b)
FIG.1

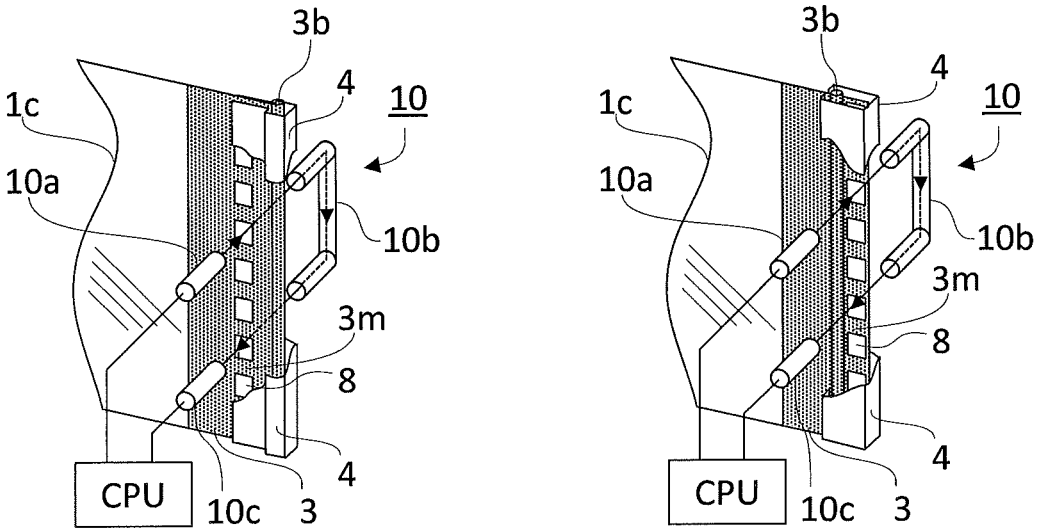
(a) FIG.2 (b)
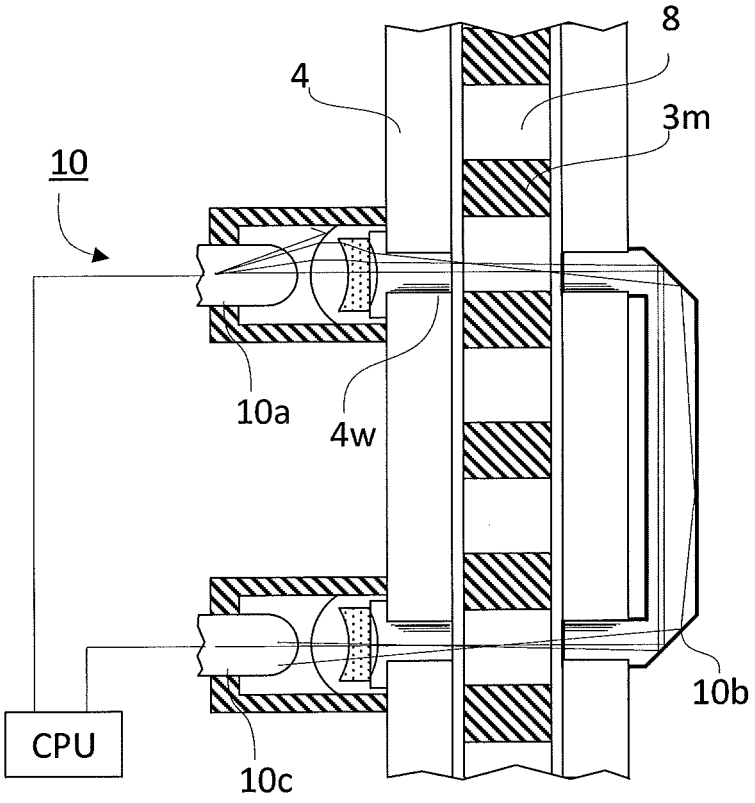
FIG.3

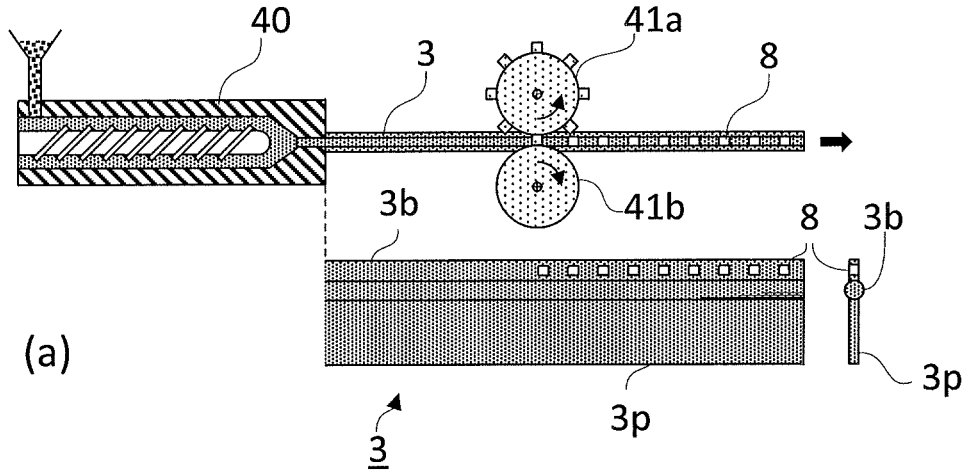
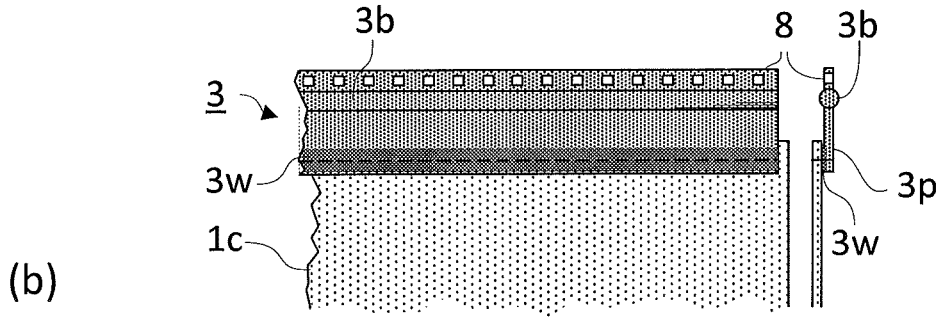
FIG.6

FAST ROLL-UP DOOR COMPRISING A CURTAIN SPEED DETECTION DEVICE

CROSS-REFERENCE TO RELATED APPLICATIONS

This application is the National Stage entry under 35 U.S.C. §371 of International Application No. PCT/EP2015/052764 filed on Feb. 10, 2015, published on Aug. 20, 2015 under publication number WO 2015/121256 A1, which claims the benefit of priority under 35 U.S.C. §119 of Sweden Patent Application Number 1450154-8 filed Feb. 12, 2014.

TECHNICAL FIELD

The present invention relates to fast roll-up doors comprising a curtain having lateral edges which are coupled to guiding rails for guiding the curtain during winding and unwinding thereof about a winding axle. In particular, it concerns such roll-up doors provided with a device for detecting the instantaneous speed and position of the curtain.

BACKGROUND FOR THE INVENTION

There are many types of shutting systems for closing a bay, separating a room or covering a swimming pool, etc. Fast roll-up doors comprise a flexible curtain suitable for being wound or unwound about a winding axle at high speed, allowing apertures of large dimensions to be opened and shut in a very short time. They are particularly suitable for closing apertures between two rooms or between a room and the outside in warehouses, workshops, shops, laboratories, and the like. In order to ensure structural stability, the lateral edges of such curtains are coupled to guiding rails fixed to the lateral walls defining the lateral edges of the aperture. The lateral edges of the curtain can freely slide along the guiding rails during winding and unwinding but are held by the rails unless exposed to an unexpected pull-out force, $F_{po}$, of sufficient magnitude to de-couple the curtain edges from their corresponding guiding rails. For example, the lateral edges of the curtain may be provided with a bead and be inserted through a slit running along a corresponding guiding rail such that the bead can freely move along the rail, but cannot pull-out through the slit unless exposed to a pre-determined pull-out force, $F_{po}$. The bead can be continuous or discontinuous, forming teeth like in a zip (cf. e.g., WO2008/155292 and WO9220895). Some doors are provided with means for automatically driving the pulled-out curtain edge back into the rail. Such re-insertion system is disclosed e.g., in WO2008/155292.

Roll-up doors can be exposed to many external aggressions, such as wind (in case they separate indoor from outdoor), accumulated rain and snow (in case the curtain is not held vertically); impacts with vehicles in movement, static obstacles placed in the closing trajectory of the curtain, and the like. Because such roll-up doors may have rather large dimensions, even a moderate pressure applied on one side of the curtain, such as by wind, can generate forces of high magnitude which are transmitted to the lateral edges of the curtain and to the coupling between lateral edges and guiding rails. In the best of cases, friction between the lateral edges of the curtain and the guiding rails may, as a consequence, be created thus hindering the winding and unwinding speed of the curtain and increasing wear rate. In the worst of cases, such forces may prevent the proper closing of the curtain. If the motor controlling the rotation of the un-winding drum is not stopped as soon as the bottom edge of the curtain is substantially hindered or fully prevented from moving forward along the guiding rails, severe damages may occur to the door. It is therefore important to control the instantaneous speed of the curtain and identify any abnormality in the closing sequence to preserve the roll-up door from any severe damages.

WO2009/090097 discloses an object-detection mechanism which is programmed to stop the closing of a gate in case an object is detected in the closing-trajectory of said gate. The object-detection mechanism comprises light emitters and light receptors with light reflectors allowing the scanning of the area of the aperture comprised between the two guiding rails through a pattern of optical rays crossing from one guiding rail to the other. Such system is only useful for the detection of an obstacle in the trajectory of the curtain, but is ill fitted for detecting any other malfunctioning of the roll-up door, such as for example a lateral edge pulling out of the corresponding guiding rail because of a strong wind.

In DE10 2005 003794 a light barrier of the same type as the foregoing system detects obstacles. The light barrier also monitors the advancement of the bottom edge of the curtain as it moves from one light barrier to the next. In order to have a fine monitoring of the position of the bottom edge of the curtain, a dense network of optical rays is required for forming a 'barrier', which increases the cost of the device.

EP2441911 discloses a system for monitoring the instantaneous speed and position of a curtain comprising an optical detection system monitoring the passage rate of discontinuous beads forming a zip used for holding the lateral edges of a curtain in a corresponding guiding rail, as discussed above. The system comprises a light emitter facing one main surface of the curtain at the level of the zip-teeth at a lateral edge thereof, and a light receptor transmits a signal to a CPU each time an emitted light ray passed across the curtain through a space separating two adjacent teeth. Such system is very efficient as long as the teeth forming the discontinuous beads are in perfect state. With wear and use, a tooth can be deformed or can fall, so that the space between two adjacent teeth is not constant anymore, yielding a wrong interpretation of the presence of a problem with the curtain, which actually does not exist. Indeed, curtains provided with a discontinuous bead at their lateral edges can continue to function very satisfactorily even if a few teeth are missing. The speed detector, however, cannot.

There therefore remains a need for a durable, reliable, and cost effective solution for monitoring the instantaneous position and speed of a curtain of a roll-up door system. The present invention proposes a solution to such problem. This and other advantages of the invention are described more in detail in the following sections.

SUMMARY OF THE INVENTION

The present invention is defined in the appended independent claims. Preferred embodiments are defined in the dependent claims. In particular, the present invention concerns a fast roll-up door for closing an aperture, said roll-up door comprising:

(a) a curtain having two opposite and parallel lateral edges extending along a longitudinal direction, and two opposite end edges joining the lateral edges, the curtain comprising a continuous bead extending parallel and adjacent to each of the two lateral edges, said continuous beads being held in, (b) a pair of elongated guiding rails suitable for interacting with the continuous beads of the lateral edges of the curtain, for holding said lateral edges, and for guiding them as the curtain is being wound or unwound about a rotating axle, X1, characterized in that, the curtain comprises a plurality of windows of same geometry and evenly distributed along a line adjacent and parallel to at least one of the continuous beads of the curtain, preferably along two lines, each one being adjacent and parallel to a corresponding continuous bead of the curtain, and in that, the roll-up door further comprises a speed device for detecting and monitoring during the winding and unwinding of the curtain about the rotating axle, X1, of the time sequence of passage of the windows before a fixed point, and thus for determining the instantaneous translation speed of the curtain along the guiding rails.

The expression "longitudinal direction" refers herein to the direction defined by the two parallel guiding rails. The expression "transverse direction" refers to a direction normal to the longitudinal direction and comprised within the plane defined by the curtain in its rest configuration (i.e., when the curtain forms a plane comprising the continuous beads held in the guiding rails). The two end edges of the curtain preferably extend along the transverse direction.

The windows are preferably of small dimensions, such as for example, a size in the longitudinal direction comprised between 3 and 30 mm, preferably between 5 and 20 mm, more preferably between 7 and 12 mm. The distance between two adjacent windows can be comprised between 5 and 50 mm, preferably between 7 and 30 mm, more preferably between 10 and 20 mm. If the windows are closer than 5 mm from one another, it could create deformation of the strip. If they are spread wider apart than 50 mm, the accuracy of the speed measurement would be reduced accordingly with longer intervals between two passages of a window before the speed device.

It is advantageous from a manufacturing and cost point of view if the curtain comprises a central portion flanked by two lateral strips, each having a free edge provided with said continuous bead and forming the lateral edges of the curtain, the windows being located on at least one of said two lateral strips, preferably on both. The lateral strips are preferably bonded to the central portion of the curtain by welding, gluing, stitching, or combinations thereof.

In a preferred embodiment, the speed device comprises:

(a) a wave emitter facing the first main surface of the curtain at the level of the line of windows and adjacent to a corresponding guiding rail, said wave emitter being capable of emitting a wave towards the curtain, which is allowed to proceed beyond the plane formed by the curtain only through the windows and being retained, i.e., absorbed or reflected, by the material separating two adjacent windows, and (b) a wave receptor capable of transmitting a signal to a central processing unit (CPU) each time it receives a wave emitted by the wave emitter which has crossed a window at least once, The emitted wave is preferably an ultraviolet light, an optical (visible) light, or an infrared light, more preferably an infrared light. The speed device is capable of determining the instantaneous speed and preferably also the instantaneous position of the curtain by counting the number of windows which passed before it.

The curtain comprises a first main surface and a second main surface separated from one another by the thickness of the curtain. In one embodiment, the wave emitter and wave receptor can be located facing the first main surface of the curtain. The speed device further comprises a wave guide located facing the second main surface of the curtain and capable of deviating a wave emitted by the wave emitter after crossing a window towards the line of windows and to the wave receptor after crossing a window.

Alternatively, the wave emitter can be located facing the first main surface of the curtain and the wave receptor can be located facing the second main surface of the curtain, opposite the wave emitter.

A fast roll-up door according to present invention may further comprise a central processing unit (CPU) capable of generating predetermined actions of the curtain depending on the time sequence of passage of the windows detected by the speed device. For example, in case said time sequence falls out of a predetermined range considered as a "normal range", the CPU is capable of generating one or several of the following actions: stop the movement of the curtain, wind up the curtain, initiate an optical or an acoustic alarm. It is most preferred that the curtain be at least stopped as soon as the time sequence falls out of the normal range.

It is advantageous that a fast roll-up door according to the present invention further comprises a system for automatic re-insertion of the continuous bead of a lateral edge of the curtain into the corresponding guiding rail after pulling out from said guiding rail. It is even more advantageous if the roll-up door comprises a corrugated portion defined by ridges and valleys extending parallel to the whole length of each lateral edge, wherein two adjacent ridges of the corrugated portions at rest are separated by a rest distance, d0, and such that the distance separating two adjacent ridges of the corrugated portions increases upon application of a pressure, P, applied substantially normal onto the surface of the curtain, and returns substantially to its rest distance, d0, upon release of the force. Such corrugated portion allows the stresses generated by a pressure applied onto the surface of the curtain to be evenly distributed along the length of both lateral edges of the curtain, and thus preventing stresses to substantially concentrate at one location of the curtain.

The present invention further concerns a process for producing a curtain suitable for use in a fast roll-up door as defined above, said process comprising the following steps:

(a) Providing a central portion of a curtain, said central portion being flexible and comprising two parallel lateral edges, (b) Extruding a lateral strip comprising a first and a second free edges and being provided with a continuous bead running parallel to the first free edge, and with a planar coupling portion located adjacent to the second free edge;

(c) Punching a series of equidistant windows of same geometry onto the lateral strip along a line running parallel to the continuous bead.

(d) Coupling the planar coupling portion of a lateral strip as defined above to both lateral edges of the central portion of the curtain. This is preferably carried out by welding, gluing, stitching, or combinations thereof.

BRIEF DESCRIPTION OF THE FIGURES

For a fuller understanding of the nature of the present invention, reference is made to the following detailed description taken in conjunction with the accompanying drawings in which:

FIG. 1: shows a general view of a roll-up door according to the present invention (a) front view, and (b) top cut view.

FIG. 2: Shows an exploded partial perspective view of two embodiments of a lateral edge of a curtain with speed detecting device according to the present invention.

FIG. 3: shows a side cut view of a lateral edge of a curtain with an example of speed detecting device.

FIG. 6: illustrates processing steps for producing a curtain according to the present invention with (a) extrusion of a lateral strip with punching of windows, and (b) coupling a lateral strip to a central portion of a curtain by welding, gluing, and/or stitching.

DETAILED DESCRIPTION OF THE INVENTION

As shown in FIG. 1(*a*), a fast roll-up door according to the present invention is useful for closing an aperture (20) which can be of large dimensions, with several meters of height and several meters of width. The roll-up door comprises a curtain (1) having two opposite and parallel lateral edges extending along a longitudinal direction, and two opposite end edges joining the two lateral edges of the curtain. Preferably, the two end edges extend along a transverse direction normal to the longitudinal direction. In a preferred embodiment the curtain therefore has a rectangular geometry, but it is possible that the end edges are not parallel, depending on manufacturing tolerances. The curtain (1) is flexible and is capable of being wound about an axle, X1. By using a flexible curtain, which is light in weight with little inertia, closing and opening of the aperture can happen at high speed, of the order of 0.7 m/s and higher. The movement of the curtain is generally controlled by a motor (5) rotating the axle, X1, to wind or unwind the curtain. The curtain is generally wound about the axle, X1, to form a drum (2), but the axle may also be used to simply change the orientation of the curtain by a given angle. In continuation, the embodiment of a drum (2) is addressed, but the teaching can apply to either embodiments.

Figure 4:
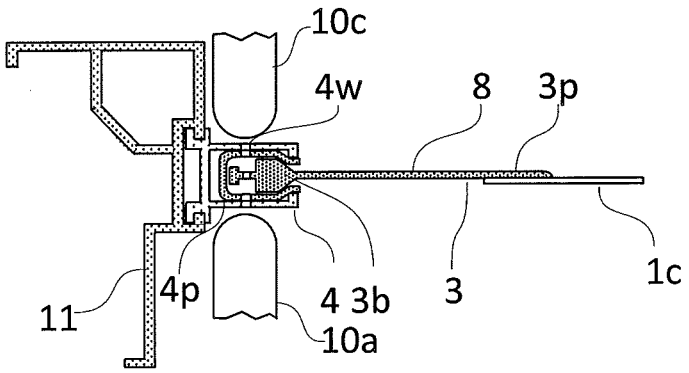
FIG. 4: shows a top cut view of a lateral edge of a curtain held in a guiding rail with an example of speed detecting device.
Figure 5:
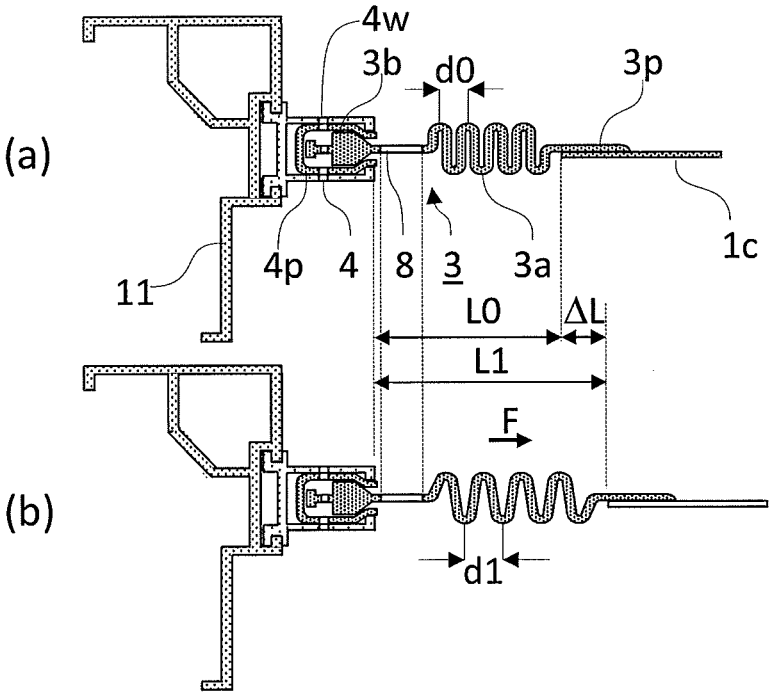
FIG. 5: shows a top cut view of a lateral edge of a curtain held in a guiding rail and provided with a corrugated portion able to stretch upon application of a force, F.

Guiding rails (4) are mounted, parallel to each other, on two opposite sides (30) of the aperture (20) with appropriate fixing means, well known to a person skilled in the art, such as profiles (11) as illustrated in FIGS. 4&5, The guiding rails (4) are suitable for, on the one hand, holding the lateral edges of the curtain (1) so as to apply a certain tension in the transverse direction to yield a smooth, wrinkleless surface and, on the other hand, for guiding the lateral edges of the curtain as it is being wound or unwound about the axle, X1. As illustrated in FIGS. 4&5, the guiding rails (4) preferably comprise a C-profile having a slit-shaped aperture facing towards the curtain and partially closed on either side by wings. Since the C-profiles are generally made of metal, it is advantageous to use a polymeric insert (4*p*) inside the guiding rail, in order to protect the lateral edges of the curtain from direct contact with possibly sharp metal edges, thus decreasing wear rate. Adjacent to or at each lateral edge of the curtain (1), a continuous bead is provided which can freely slide inside the volume defined by the C-profile, but cannot pull-out through the slit shaped opening of the guiding rails, unless a pull-out force, $F_{po}$, is reached. The magnitude of the pull-out force, $F_{po}$, should be sufficiently high to prevent the lateral edges of the curtain from pulling out of the guiding rails at the first stress, but sufficiently low to prevent the curtain from tearing or the guiding rails from being damaged. Such guiding rails are known in the art and are described elsewhere, such as in WO2008/155292. The latter document also discloses an automatic re-insertion device allowing the automatic re-insertion of a lateral edge of a curtain after pulling-out from a guiding rail. Such device can of course advantageously be implemented in the present invention. The disclosures of WO2008/155292 are herein included by reference. It is clear that other guiding rail/lateral edge coupling means known in the art can be used instead in the present invention as long as they allow both (a) holding the lateral edges of the curtain and (b) free sliding along the guiding rails.

As shown in FIGS. 1(*a*), 2&6(*b*), the curtain comprises at least one, preferably two, series of windows (8) of same geometry evenly distributed along a line parallel and adjacent to at least one of the, preferably both lateral edges of the curtain. A window (8) is defined herein as a through hole of closed perimeter, fluidly communicating one main surface of the curtain with a second main surface of the curtain, separated from the first main surface by the thickness of the curtain. The windows all have the same geometry. Apart from that, there is no particular restriction on the actual geometry of the windows. From a practical point of view, however, they are preferably rectangular (or square), preferably with a first pair of opposite edges extending along the longitudinal direction, and with a second pair of opposite edges extending along the transverse direction. This geometry is preferred because the level of an edge of the second pair of edges does not depend on the position of the continuous bead within a guiding rail in the transverse direction, as would be the case with a window of e.g., circular geometry. As shown in FIG. 2(*a*)&(*b*), the windows (8) can be located between the curtain free edge and the continuous bead (3*b*) (cf. FIG. 2(*b*)) or can be separated from the free edge of the curtain by the continuous bead (3*b*). In the latter embodiment, it is preferred that the continuous bead (3*b*) forms the actual free edge of the curtain.

Regardless of the windows geometry, though rectangular or square windows are preferred, the windows (8) preferably have a size in the longitudinal direction comprised between 3 and 30 mm, preferably between 5 and 20 mm, more preferably between 7 and 12 mm. The (shortest) distance separating two adjacent windows is preferably comprised between 5 and 50 mm, preferably between 7 and 30 mm, more preferably between 10 and 20 mm. The lower the distance separating two adjacent windows and the smaller the windows in the longitudinal direction, the finer is the monitoring of the instantaneous position and speed of the curtain. Too low a distance between two adjacent windows it could create deformation of the strip. A person skilled in the art is perfectly capable of dimensioning the windows and windows sequence to fulfil the requirements of both mechanical resistance and measurement accuracy depending on the specific configuration of a door.

The use of windows (8) defined by a closed perimeter according to the present invention has the advantage over the teeth of a zip as used in EP2441911 as reference for the detection of the speed and position of a curtain because unlike the teeth of a zip, such windows maintain their geometry over a long service time. Indeed, the teeth of a zip are exposed to severe wear conditions upon use, in particular if the curtain is pulled out of a guiding rail and later re-inserted therein, and can therefore be deformed or even broken. Furthermore, the teeth of such zips are manufactured by injection moulding onto ribbons, which substantially increases the cost of the curtain.

The roll-up door of the present invention further comprises a speed device (10) for detecting and monitoring during the winding and unwinding of the curtain about the rotating axle, X1, the time sequence of passage of the windows (8) before a fixed point. From such time sequence the instantaneous translation speed of the curtain along the guiding rails (4) can easily be determined. The curtain comprises a first main surface and a second main surface separated from one another by the thickness of the curtain.

As illustrated in FIGS. 1 to 4, the speed device (10) comprises:

(a) a wave emitter (10*a*) facing the first main surface of the curtain (1) at the level of the line of windows (8) and adjacent to a corresponding guiding rail (4). The wave emitter is capable of emitting a wave towards the curtain, which is allowed to proceed beyond the plane formed by the curtain only through the windows (8) and which is retained, i.e., absorbed or reflected, by the material (3*m*) separating two adjacent windows (8), and (b) a wave receptor (10*c*) capable of transmitting a signal to a central processing unit (CPU) each time it receives a wave emitted by the wave emitter (10*a*) which has crossed a window (8) at least once, The emitted wave is preferably an ultraviolet light, an optical (visible) light, or an infrared light. The emitted wave is more preferably an infrared light.

In a first embodiment, illustrated in FIGS. 1 to 3, the speed device is of the type described in EP2441911, which content is herein included by reference. In particular, the wave emitter (10*a*) and wave receptor (10*c*) are both located facing the first main surface of the curtain. The speed device (10) further comprises a wave guide (10*b*) located facing the second main surface of the curtain and capable of deviating a wave emitted by the wave emitter (10*a*) after crossing a window (8) towards the line of windows and to the wave receptor (10*c*) after crossing a window (8). As shown in FIGS. 2&3 a wave emitted by the wave emitter (10*a*) must cross the curtain twice before it reaches the wave receptor (10*c*). This is achieved by using a wave deviator (10*b*), which is preferably made of a material transparent to the emitted wave and based on the principle of total internal reflection, like a fibre optic. The distance separating the wave emitter (10*a*) from the wave receptor (10*c*) must of course be calibrated with respect to the periodicity of the windows (8) aligned along the longitudinal direction. The advantage of using such type of speed detector relies on the fact that the measurement characterizes a portion of the curtain's trajectory, corresponding to the distance between wave emitter (10*a*) and wave receptor (10*c*), and is not punctual as is the case with the second embodiment disclosed below.

In a second embodiment, illustrated in FIG. 4, the wave emitter (10*a*) is located facing the first main surface of the curtain and the wave receptor (10*c*) is located facing the second main surface of the curtain and facing the wave emitter (10*a*). As discussed above, this embodiment characterizes a single point of the curtain's trajectory. On the other hand, it is simpler to install. Regardless of the type of speed detector (10) used, a fast roll-up door according to the present invention may comprise more than one speed detector per lateral edge. This could be interesting for example with doors of particularly large dimensions in the longitudinal direction.

To avoid drafts through the windows (8) when the door is closed, it is preferred that the windows be covered by the guiding rails (4). This has also the advantage of protecting the windows from any external aggression, thus preserving their integrity over a longer time. The various elements of the speed detector (10) can thus be fixed directly on the guiding rails, which must of course be provided with holes (4*w*) to let the emitted and optionally deviated waves to propagate through the windows (8) or hit the material (3*m*) separating two adjacent windows (cf. FIGS. 3&4). FIG. 2(*a*)&(*b*) illustrate two embodiments of how the windows (8) can be covered by the guiding rails. In FIG. 2(*a*), the curtain free edge is formed by a continuous bead, and the windows (8) are aligned parallel to said bead. The guiding rails (4) comprise a C-shape portion to hold the continuous bead (3*b*) within the rail as discussed above, and are prolonged by a planar portion extending transversally over the lateral portion of the curtain, such as to cover the windows (8). In this embodiment, the windows are exposed to any stress applied onto the lateral edges of the curtain generated by a pressure applied to the plane of the curtain. This means that they must be sufficiently mechanically stable to not deform, or even tear upon application of a force of not more than the pull-out force, $Fp_o$.In an alternative embodiment, schematically illustrated in FIGS. 2(*b*) and 4, the windows (8) are aligned between the continuous bead (3*b*) and the curtain free edge. This embodiment has two main advantages over the previous one. First, the windows (8) are better protected from the exterior, such that drafts cannot run through them, and second, the windows (8) are not exposed to any forces when stresses are generated onto the curtain retained in the guiding rails by the continuous bead (3*b*).

The speed detector (10) is connected to a central processing unit (CPU). The wave receptor (10*c*) is preferably a photodiode capable of sending an electrical signal to the CPU each time it is hit by a wave emitted by the wave emitter (10*a*) after crossing windows at least once. The CPU records the signals sent by the wave receptor (10*c*) every time it is hit by a wave, and is able to calculate the instantaneous closing/opening speed of the curtain by measuring the time sequence of hits. By counting the number of hits—or windows passing before the speed device (10)—the CPU can also determine the instantaneous position of the curtain. It suffices to set the counter to zero when the curtain is closed and count the number of windows passing before the speed detector (10) as the curtain is being opened and closed.

The CPU can also be programmed to generate predetermined actions of the curtain depending on the time sequence of passage of the windows (8) detected by the speed device (10). In particular, in case the curtain hits an obstacle or a lateral edge pulled out of a guiding rail (4), the windows would stop passing before the speed detector, or would do so at an erratic rate. If the time sequence measured by the CPU falls out of a predetermined range, the CPU is capable of generating one or several emergency actions. In particular, the first emergency action is to stop the motor (5) driving the motion of the curtain. This measure ensures that no damages can be generated by forcing the movement of the curtain. A second emergency action can be to wind up the curtain. The retrieval of the curtain allows the liberation of a potential obstacle and, for roll-up doors provided with an automatic re-insertion system, it allows the re-insertion of a continuous bead (3*b*) which would have been pulled-out of a guiding rail (4). Finally, the CPU may trigger an optical or an acoustic alarm to draw the attention of the users. It is preferred that the roll-up door of the present invention comprises a system of the type disclosed in WO2008/

155292, for automatic re-insertion of the continuous bead (3*b*) of a lateral edge of the curtain into the corresponding guiding rail (4), in case the continuous bead pulled out from said guiding rail.

In a preferred embodiment illustrated in FIG. 5, the curtain comprises, close to its lateral edges, a corrugated portion (3*a*) defined by ridges and valleys extending parallel to the whole length of each lateral edge. At the rest configuration, L0, two adjacent ridges of the corrugated portions are separated by a rest distance, d0 (cf. FIG. 5(*a*)). Upon application of a force, F, on the lateral edges of the curtain, the distance separating two adjacent ridges of the corrugated portions increases to a stretched distance, d1, allowing the resilient portion to stretch by LL to reach a stretched configuration, L1 (cf. FIG. 5(*b*)). Upon release of the force, F, the distance between two adjacent ridges returns substantially to its rest distance, d0, so that the resilient portion returns to its rest configuration, L0. The crest-to-valley amplitude of a corrugation is preferably comprised between 7 and 9 mm, and the rest distance, d0, between two adjacent crests is preferably comprised between 7 and 9 mm. The advantage of such corrugation (3*a*) is that forces generated at the lateral edges of the curtain by a pressure applied against one of the first and second main surfaces of the curtain can be distributed evenly along the whole length of both lateral edges, thus avoiding local peaks of stress concentration which could damage the curtain or the guiding rails even with moderate pressures.

From a processing point of view, it is particularly preferred that the curtain comprises a central portion (1*c*) flanked by two lateral strips (3). Each lateral strip (3) has a first free edge suitable for forming a lateral edge of the curtain, and a second free edge suitable for being bonded to the central portion (1*c*) of the curtain as is explained below. Each strip is also provided with a continuous bead (3*b*) extending parallel to the first edge of the strip. It can form said first free edge, as illustrated in FIG. 2(*a*), or it can be located adjacent to said first free edge as illustrated in FIGS. 2(*b*) and 6 (compare also the right hand side and the left hand side of the curtain illustrated in FIG. 1(*b*)). The windows (8) are located on at least one of said two lateral strips (3), preferably on both. The central portion (1*c*) of the curtain can be made of any material traditionally used for such purpose, such as a fabric of polyester or aramid fibres impregnated with a polymer such as PVC, polyurethane, silicone, yielding good mechanical stability and imperviousness to fluids, such as rain, wind, and the like. The lateral strips (3) can be manufactured separately, preferably by extrusion, and coupled to and on either side of a central portion (1*c*) of a curtain by any of welding, gluing, stitching, or combinations thereof. Such configuration allows a highly automated and cheap manufacturing of curtains suitable for the roll-up doors according to the present invention as illustrated in FIG. 6 and discussed below.

A lateral strip (3) can be made of a polymer and produced by extrusion through a die forming a first free edge, a second free edge, a continuous bead (3*b*) extending parallel to the first free edge, and a planar portion (3*p*) adjacent to the second free edge and suitable for coupling the strip (3) to a central portion (1*c*) of curtain (cf. FIG. 6(*a*)). The strips can be made of a polymer such as polyurethane (TPU), thermoplastic elastomer (TPE), and the like. Windows (8) can be formed in-line during the extrusion phase. For example, as illustrated in FIG. 6(*a*), a mechanical puncher in the shape of a roller (41*a*) with punching pins and a counter roller (41*b*) can be used to punch windows once the strip has cooled sufficiently. Alternatively, a vertical puncher can reciprocate up and down vertically at a given frequency determining the distance separating two adjacent windows. In case the strip (3) comprises a corrugated portion (3*a*) it can be formed by use of an appropriate extrusion die with no technical difficulty. In case the windows (8) are separated from the curtain free edge by the continuous bead (3*b*) as shown in FIG. 2(*a*), the portion of the strip (3) comprising the windows must be mechanically sufficiently stable for preventing any substantial deformation of the windows (8) caused by external forces applied onto the curtain, lest the speed and position measurements would be biased.

A strip (3) produced as discussed above and illustrated in FIG. 6(*a*), is coupled on two opposite lateral edges of a central portion (1 c) of a curtain cut to the desired dimensions. As illustrated in FIG. 6(*b*), the coupling between a strip (3) and central portion (1*c*) can be formed by overlapping the planar portion (3*p*) of the strip and a portion adjacent to the lateral edges of the central portion of the curtain and forming a bond (3*w*) between them. If both lateral strip (3) and central portion (1*c*) of the curtain comprise thermoplastic materials, bonding (3*w*) can advantageously be formed by welding. Else glue can be used instead. Alternatively or concomitantly, stitching remains a favourite and reliable coupling means, used alone, or in combination to reinforce a welding or glue line.

The fast roll-up doors of the present invention therefore provide all the advantages of speed and position determination of a curtain as described in EP2441911 but reliability on the long term is substantially enhanced because windows (8) are much more stable and exposed to much less stresses than the teeth of zip type discontinuous bead, and cost is substantially lowered, because the curtain can be produced as discussed above in a fully automated process requiring no expensive injection moulding tool for the production of teeth. Installation of a roll-up door according to the present invention is therefore exactly the same as for a state of the art roll-up door, with the additional mounting of a speed device (10). A speed device (10) can be added to a state of the art roll-up door already operational, provided the curtain is changed to comprise the windows (8).

The invention claimed is:

1. A fast roll-up door for closing an aperture, said roll-up door comprising:

(a) a curtain having two opposite and parallel lateral edges extending along a longitudinal direction, and two opposite end edges joining the lateral edges, the curtain comprising continuous beads extending parallel and adjacent to each of the two lateral edges;

(b) a pair of elongated guiding rails suitable for interacting with the continuous beads of the lateral edges of the curtain for holding said lateral edges and for guiding them as the curtain is being wound or unwound about a rotating axle, wherein said continuous beads are held in corresponding guiding rails, wherein the curtain comprises a plurality of windows of same geometry and evenly distributed along a line adjacent and parallel to at least one of the continuous beads of the curtain, and wherein the roll-up door further comprises a speed device for detecting and monitoring, during the winding and unwinding of the curtain about the rotating axle, of the time sequence of passage of the windows before a fixed point, and for determining the instantaneous translation speed of the curtain along the guiding rails.

2. The fast roll-up door according to claim 1, wherein the windows have a size in the longitudinal direction between 3 and 30 mm and the distance between two adjacent windows is between 5 and 50 mm.

3. The fast roll-up door according to claim 1, wherein the windows are evenly distributed along two lines, each line being adjacent and parallel to a corresponding continuous bead of the curtain.

4. The fast roll-up door according to claim 1, wherein the curtain comprises a central portion flanked by two lateral strips, each lateral strip having a free edge proximal with said continuous bead and forming the lateral edges of the curtain, the windows being located on at least one of said two lateral strips.

5. The fast roll-up door according to claim 4, wherein the lateral strips are bonded to the central portion of the curtain by welding, gluing, stitching, or combinations thereof.

6. The fast roll-up door according to claim 1, wherein the curtain comprises a first main surface and a second main surface separated from one another by the thickness of the curtain, and wherein the speed device comprises:

(a) a wave emitter facing the first main surface of the curtain at a level of the line of windows and adjacent to a corresponding one of the guiding rails, said wave emitter being capable of emitting a wave towards the curtain, which is allowed to proceed beyond a plane formed by the curtain only through the windows and which is interrupted by the material separating two adjacent windows, and (b) a wave receptor capable of transmitting a signal to a central processing unit each time it receives a wave emitted by the wave emitter which has proceeded though one of the windows, wherein the emitted wave is an ultraviolet light, an optical light, or an infrared light.

7. The fast roll-up door according to claim 6, wherein the wave emitter and wave receptor are located facing the first main surface of the curtain, and the speed device further comprises a wave guide located facing the second main surface of the curtain and capable of redirecting the wave emitted by the wave emitter after proceeding through the one window back through the one window to the wave receptor.

8. The fast roll-up door according to claim 6, wherein the wave emitter is located facing the first main surface of the curtain and the wave receptor is located facing the second main surface of the curtain and facing the wave emitter.

9. The fast roll-up door according to claim 1, wherein the speed device is capable of determining the instantaneous position of the curtain by counting a number of the windows passed before it.

10. The fast roll-up door according to claim 1, further comprising a central processing unit capable of generating predetermined actions of the curtain depending on the time sequence of passage of the windows detected by the speed device, wherein, when said time sequence falls out of a predetermined range, the central processing unit is capable of generating one or several of the following actions: stop the movement of the curtain, wind up the curtain, and initiate an optical or an acoustic alarm.

11. The fast roll-up door according to claim 1, comprising a system for automatic re-insertion of the continuous bead of a lateral edge of the curtain into the corresponding guiding rail in response to the continuous bead being pulled out from said guiding rail.

12. The fast roll-up door according to claim 1, wherein the curtain comprises a corrugated portion defined by ridges and valleys extending parallel to the whole length of each lateral edge, wherein two adjacent ridges of the corrugated portions at rest are separated by a rest distance and the distance separating two adjacent ridges of the corrugated portions increases upon application of a pressure applied substantially normal onto the surface of the curtain, and returns substantially to the rest distance upon release of the pressure.

13. A process for producing a curtain suitable for use in the fast roll-up door according to claim 1, said process comprising the following steps:

(a) providing a central portion of a curtain, said central portion being flexible and comprising two parallel lateral edges, (b) extruding a lateral strip comprising a first and a second free edges and being provided with a continuous bead running parallel to the first free edge, and with a planar coupling portion located adjacent to the second free edge;

(c) punching a series of equidistant windows of same geometry onto the lateral strip along a line running parallel to the continuous bead (d) coupling the planar coupling portion of a lateral strip as defined above to both lateral edges of the central portion of the curtain.

14. The process according to claim 13, wherein the step of coupling the lateral strips to both lateral edges of the central portion of the curtain is carried out by welding, gluing, stitching, or combinations thereof.

15. The fast roll-up door according to claim 1, wherein the windows have a size in the longitudinal direction between 5 and 20 mm and the distance between two adjacent windows is between 7 and 30 mm.

16. The fast roll-up door according to claim 1, wherein the windows have a size in the longitudinal direction between 7 and 12 mm, and the distance between two adjacent windows is between 10 and 20 mm.

* * * * *